US006254255B1

(12) United States Patent
Entrop et al.

(10) Patent No.: US 6,254,255 B1
(45) Date of Patent: Jul. 3, 2001

(54) LUMINAIRE

(75) Inventors: Jean P. Entrop; Hendrik Wijbenga, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/396,562

(22) Filed: Sep. 15, 1999

(30) Foreign Application Priority Data

Sep. 17, 1998 (EP) ..... 98203101

(51) Int. Cl.[7] ..... F21V 7/00

(52) U.S. Cl. ..... 362/310; 362/342; 362/297; 362/346; 362/223

(58) Field of Search ..... 362/310, 223, 362/342, 354, 297, 346

(56) References Cited

U.S. PATENT DOCUMENTS 5,564,820 10/1996 Entrop et al. ..... 362/362

5,806,972 * 9/1998 Kaiser et al. ..... 362/290

FOREIGN PATENT DOCUMENTS 1904982 8/1970 (DE) .

* cited by examiner

*Primary Examiner*—Sandra O'Shea
*Assistant Examiner*—Ronald E. DelGizzi
(74) *Attorney, Agent, or Firm*—Dicran Halajian

(57) ABSTRACT

The luminaire has a concave reflector (2) including a light-emission window (3) and a plane of symmetry S transverse thereto. The reflector (2) has first opposing walls (21) which extend along the plane of symmetry S, and second opposing walls (26) which extend at right angles thereto, and a top wall (27). The top wall (27) has an opening (28) which is covered with a reflecting shade (30) having first faces (31) along the plane of symmetry S, and second faces (36) at right angles to the plane of symmetry S, and a top face (37) opposite the light-emission window (3). A holder (4) positions an electric lamp e.1. in the opening (28) and in the plane of symmetry S. The luminaire is compact and suited to illuminate covered traffic areas.

10 Claims, 4 Drawing Sheets

LUMINAIRE

BACKGROUND OF THE INVENTION

The invention relates to a luminaire having a housing with a concave reflector with a plane of symmetry and a light emission window, and a holder for positioning an electric lamp in the plane of symmetry. The reflector has first opposing walls having flat strips extending along the plane of symmetry, second opposing walls transverse to the plane of symmetry, and a top wall opposite the light emission window.

Such a luminaire is disclosed in U.S. Pat. No. 5,564,820.

The known luminaire may be mounted in a ceiling. The flat strips of the first walls serve to spread the light generated by an accommodated lamp in directions transverse to the plane of symmetry. However, the strips do give rise to second reflections at the second walls. The second walls are flat, between straight bending lines along the light-emission window, so as to widen the light beam in the longitudinal direction of the lamp to be accommodated.

The known luminaire has the drawback that the reflector is voluminous, thus requiring the housing to be relatively large, particularly if the housing must accommodate means for feeding and starting the mounted lamp.

DE-A-1 904 982 discloses a luminaire in which reflectors are present in a housing situated at the side of a high-pressure discharge lamp arranged in a plane of symmetry. The reflectors are composed of flat strips extending along the light-emission window, and having a bending line in surfaces extending transversely to the light-emission window, the strips being bent towards each other along the bending line. The flat strips may flare out from the bending lines of the light-emission window. Opposite the light-emission window, the reflectors are covered with a flat reflector.

This luminaire too is very voluminous, while, in addition, the housing is closed with a dish-shaped transparent shield, parts of which extending perpendicularly to the light-emission window being used as an optical screen.

SUMMARY OF THE INVENTION

It is an object of the invention to provide a luminaire of the type described in the opening paragraph, which is of a compact construction.

In accordance with the invention, this object is achieved in that the top wall has an aperture in the plane of symmetry S, which is covered with a reflective shade, said shade including first opposing surfaces extending along the plane of symmetry, second opposing surfaces extending transversely to the plane of symmetry S, and a top surface opposite the light-emission window, the means being positioned so as to keep the electric lamp e.1. to be accommodated in place in the aperture.

The shade narrows the reflector at some distance from the light-emission window, thus enabling the lamp to be accommodated to be substantially half surrounded, in the plane of symmetry and in a plane transverse thereto, with much smaller reflecting surfaces. As a result, also the dimension of the reflector transverse to the light-emission window is smaller and the luminaire is compact. Besides, relatively expensive reflector material is saved.

It is favorable if the first surfaces of the shade comprise flat strips extending along the light-emission window. As a result, the spread of the light generated by an accommodated lamp in directions transverse to the plane of symmetry is better than it would be if the first surfaces were bent.

In a favorable embodiment, the second surfaces of the shade are flat and, towards the top surface, the distance between them decreases. In a variant of this embodiment, also the second walls are flat and the distance between them decreases in the direction of the top wall.This embodiment, and the variant thereof, have the advantage that light incident on these reflector parts is spread strongly in the direction of the plane of symmetry and in the surrounding directions.

In an advantageous embodiment, the first walls are provided with a bend in surfaces extending transversely to the light-emission window, so as to form a center panel and side panels connected thereto. In this manner, it is counteracted that light is reflected by a first wall onto a second wall. Reflection at a second wall would cause a loss of light, since each reflection is accompanied by absorption.

In a particular embodiment, the first walls are bent so strongly that light incident on the side panels diagonally traverses the reflector upon reflection, so as to form a wide beam transverse to the plane of symmetry. This additionally results in second reflections at the second walls being precluded even more. For this purpose, the side panels generally include an angle ranging from 130 to 135° with each other in the light-emission window. The reflectors of the above-mentioned DE 1 904 982 are bent much more faintly.

Contrary to what is stated in the document mentioned in the previous paragraph, in a favorable variant of the two embodiments just mentioned, the flat strips in the side panels extend from the center panel towards the light-emission window. As a result, the incident light is sent out by the side panels at a larger angle with respect to the light-emission window. Consequently, the light in question forms a better supplement to the light reflected by the center panel, as will be apparent from FIG. 5.

It is advantageous if the top surface has a bent, convex fold which extends in the plane of symmetry. In this case, the light reflected by the relevant reflector part is not cast back to the lamp, but is spread in directions transverse to the plane of symmetry.

Preferably, a flat transparent shield is used to close the light-emission window. The transparent shield precludes soiling of the reflector and can be readily cleaned. In addition, a flat transparent shield, for example of glass or a synthetic resin, is easy to manufacture.

It is also preferred that the reflector has a first and a second lamella in the light-emission window at and along each one of the second walls. The lamellae limit, in the direction of the plane of symmetry and in directions surrounding the plane of symmetry, the angle with the light-emission window at which light is emittted. The reflector gives such a limitation in directions transverse to the plane of symmetry. When the transparent shield is removed, the lamellae nevertheless do not hamper the exchange of the lamp in the luminaire, since the lamp can be passed between the lamellae.

The luminaire can very suitably be used to accommodate a lamp with a light source whose length in the plane of symmetry is greater than its width in directions transverse thereto, for example a halogen incandescent lamp or a high-pressure discharge lamp, such as a high-pressure sodium lamp or a high-pressure mercury lamp, for example containing metal-halide additions, and having, for example, a quartz-glass or ceramic envelope, such as an envelope of aluminium oxide.

The luminaire can particularly suitably be used to illuminate traffic areas provided with a roof, such as petrol stations.

These and other aspects of the invention will be apparent from and elucidated with reference to the embodiment(s) described hereinafter.

IN THE DRAWINGS:

DETAILED DESCRIPTION OF THE EMBODIMENT

Figure 1:
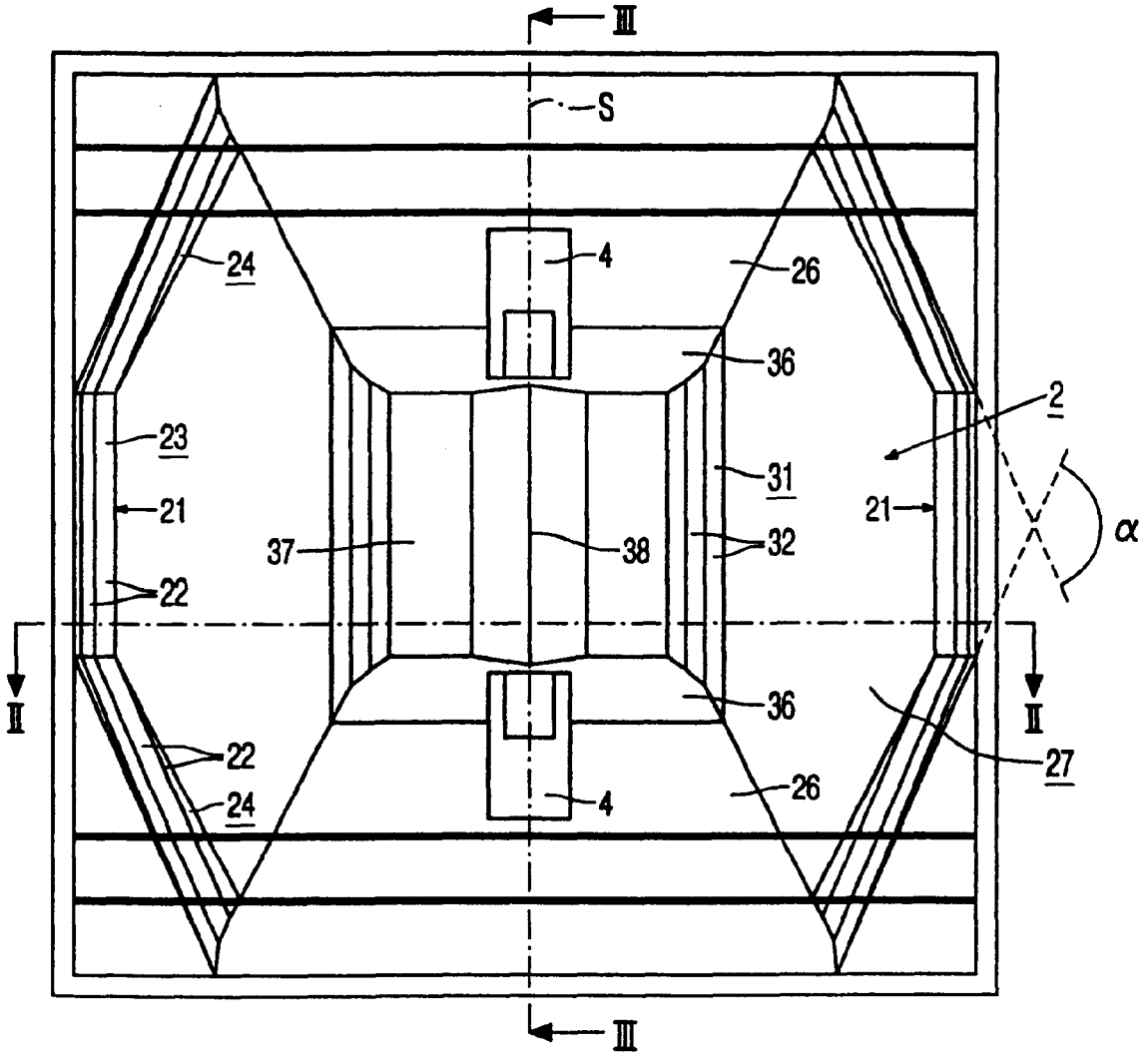
FIG. 1 is an inside view of the luminaire.
Figure 2:
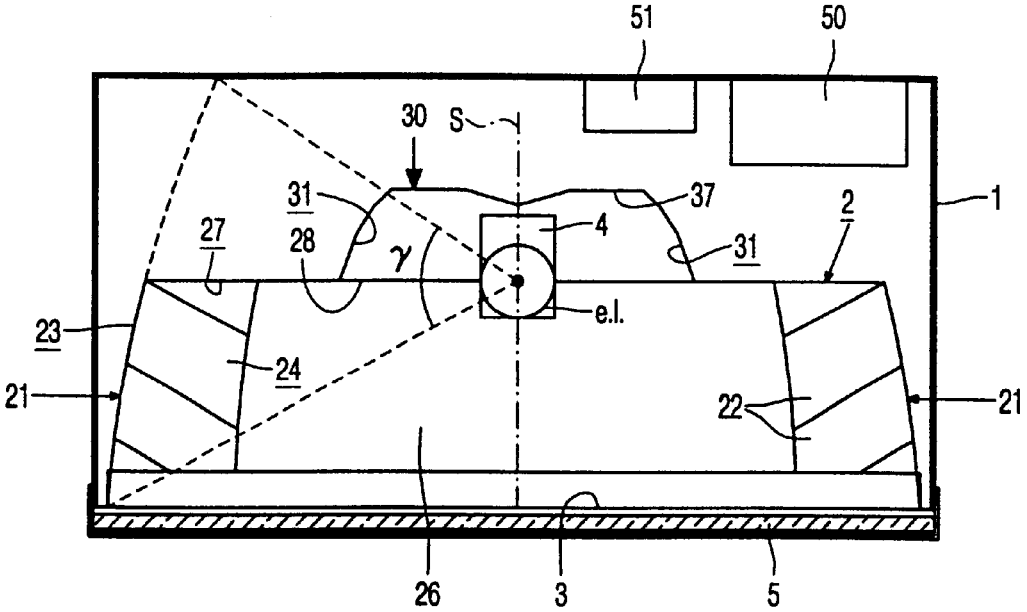
FIG. 2 is a cross-sectional view of the luminaire, taken on the line II—II in FIG. 1.
Figure 3:
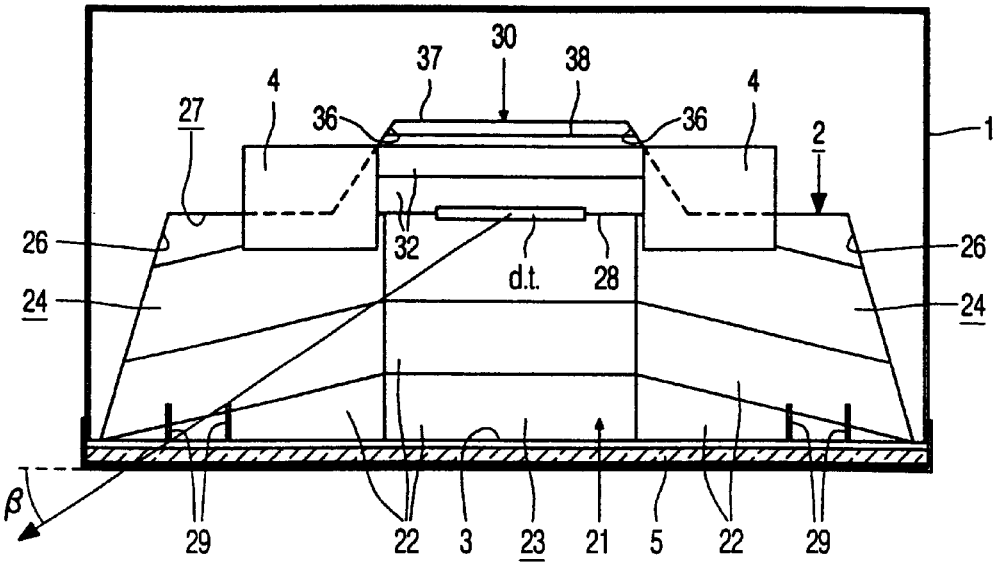
FIG. 3 is a cross-sectional view of the luminaire, taken on the line III—III in FIG. 1.

In FIGS. 1, 2 and 3, the luminaire comprises a housing 1, which accommodates a concave reflector 2 with a light-emission window 3. A plane of symmetry S extends transversely to the light-emission window 3. A holder 4 is present to accommodate an electric lamp e.1. in the reflector 2, in the plane of symmetry S and along the light-emission window 3. The holder 4 is designed for a lamp provided with a lamp cap on two sides, however, this is not essential to the invention, which can also be applied for a lamp having a base on one side.

The reflector 2 has first opposing walls 21, which extend along the plane of symmetry S, and which include flat strips 22, which extend along the light-emission window 3, and second opposing walls 26 which extend transversely to the plane of symmetry S. A top wall 27 of the reflector 2 is situated opposite the light-emission window 3.

The top wall 27 has an aperture 28 in the plane of symmetry S, which aperture is covered with a reflecting shade 30. The shade 30 has first opposing surfaces 31 along the plane of symmetry S, second opposing surfaces 36 transverse to the plane of symmetry S, and a top surface 37 opposite the light-emission window 3. The means 4 are arranged so as to keep the electric lamp e.1. to be received, see FIG. 2, in the aperture 28.

The reflector may have a paint coating or a metallic surface. The reflector may be matt, high-gloss or semi-high gloss. The optical function of the top wall 27 is only of secondary importance since light only brushes it. As a result, the choice of the material used for the top wall is of little importance. In the drawing, use is made of a semi-high gloss material.

FIG. 2 shows that the housing 1 would be too small to accommodate the reflector 2 if the first walls 21 would extend further in the housing to surround the electric lamp e.1. through the same angle $\gamma$ as the first walls 21 and the first faces 31 jointly do in the Figure. FIG. 2 further shows that the luminaire in accordance with the invention half surrounds the electric lamp e.1. with relatively small first and second surfaces and a relatively small top surface. As a result, reflective material is saved, the luminaire is compact and the housing is large enough to accommodate a power supply 50 and a starter 51 if the electric lamp e.1. is a discharge lamp.

FIGS. 1 and 3 clearly show that the first surfaces 31 of the shade 30 have flat strips 32 which extend along the light-emission window 3.

FIG. 3 clearly shows that the second surfaces 36 of the shade 30 are flat and that, towards the top surface 37, the distance between them decreases. It also shows that the second walls 21 are flat and that, towards the top wall 27, the distance between them decreases. They spread the incident light in the plane of the drawing shown in FIG. 3 and emit the light through the light-emission window 3.

FIGS. 1 and 3 show most clearly that the first walls 21 have a bend in surfaces extending transversely to the light-emission window 3, to form a center panel 23 and side panels 24 connected thereto.

The side panels 24 include an angle of 130–135° with each other in the light-emission window 3, in FIG. 1 an angle $\alpha$ of 132°.

The flat strips 22 in the side panels 24 extend from the center panel 23 towards the light-emission window 3, see, in particular, FIG. 3.

The top surface 37 has a bent convex fold 38 which extends in the plane of symmetry S and which casts incident light sideways.

A flat transparent shield 5 closes the light-emission window 3, see FIGS. 2 and 3.

The reflector 2 has a first and a second lamella 29 in the light-emission window 3 at and along each one of the second walls 26. The lamellae preclude that, in the plane of symmetry S, light is emitted at an angle $\beta$ with the light-emission window 3, which can be dazzling. The reflector 2 itself forms such a screened angle with its first walls 21, which angle extends transversely to the plane of symmetry S.

The received electric lamp e.1. shown in FIG. 2 is a high-pressure sodium discharge lamp which, in operation, consumes 150 W and has an output of approximately 110 lm/W. Its discharge vessel d.t., see FIG. 3, is made of a ceramic material, for example polycrystalline alumina.

Figure 4:
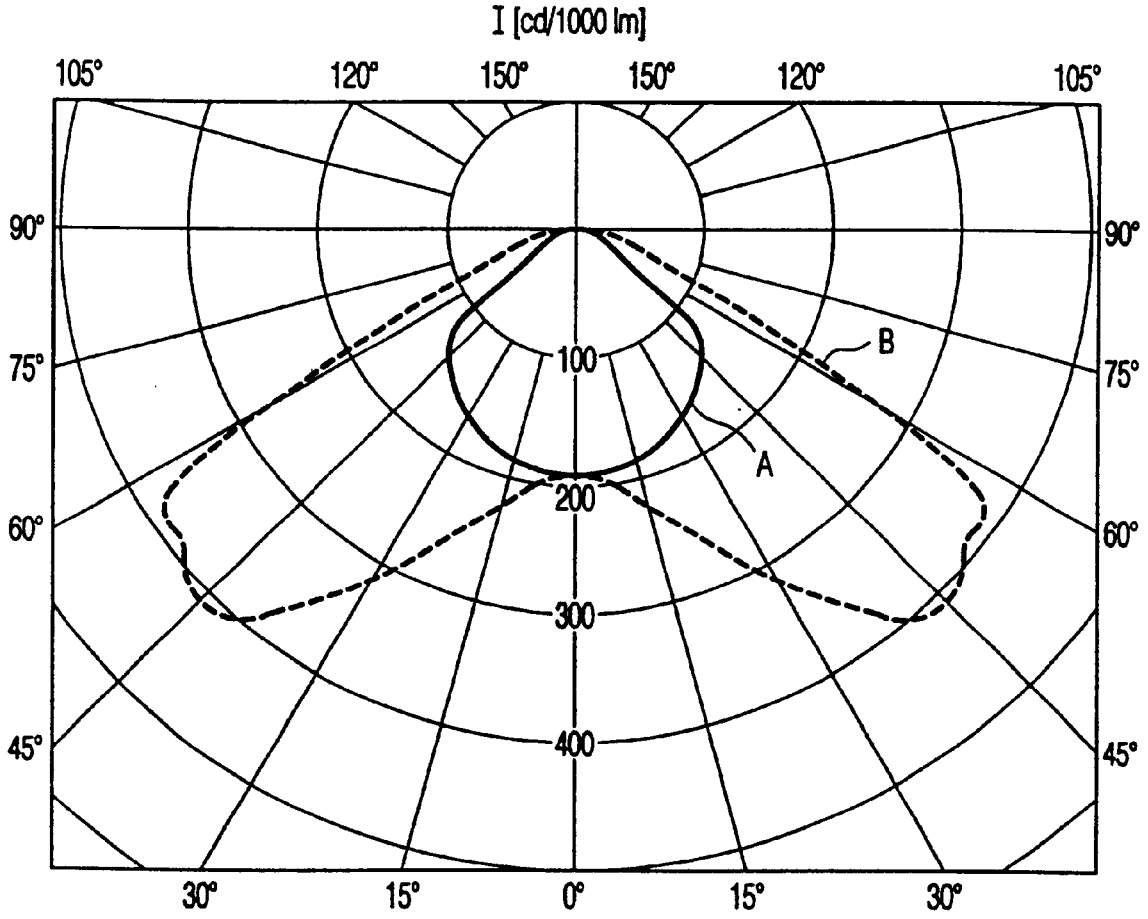
FIGS. 4 and 5 show light intensity-distribution diagrams of the luminaire.

FIG. 4 shows intensity diagrams which are obtained by using the luminaire shown in FIGS. 1 through 3 and this lamp. The continuous line A shows the distribution in the plane of symmetry S, the interrupted line B shows the distribution in the plane perpendicular thereto and perpendicular to the light-emission window 3. The Figure shows that the luminaire causes the light beam to be strongly laterally directed with respect to the plane of symmetry S, with a maximum at an angle of approximately 44° with the vertical, but the values being only slightly lower between approximately 38° and approximately 56°.

Figure 5:
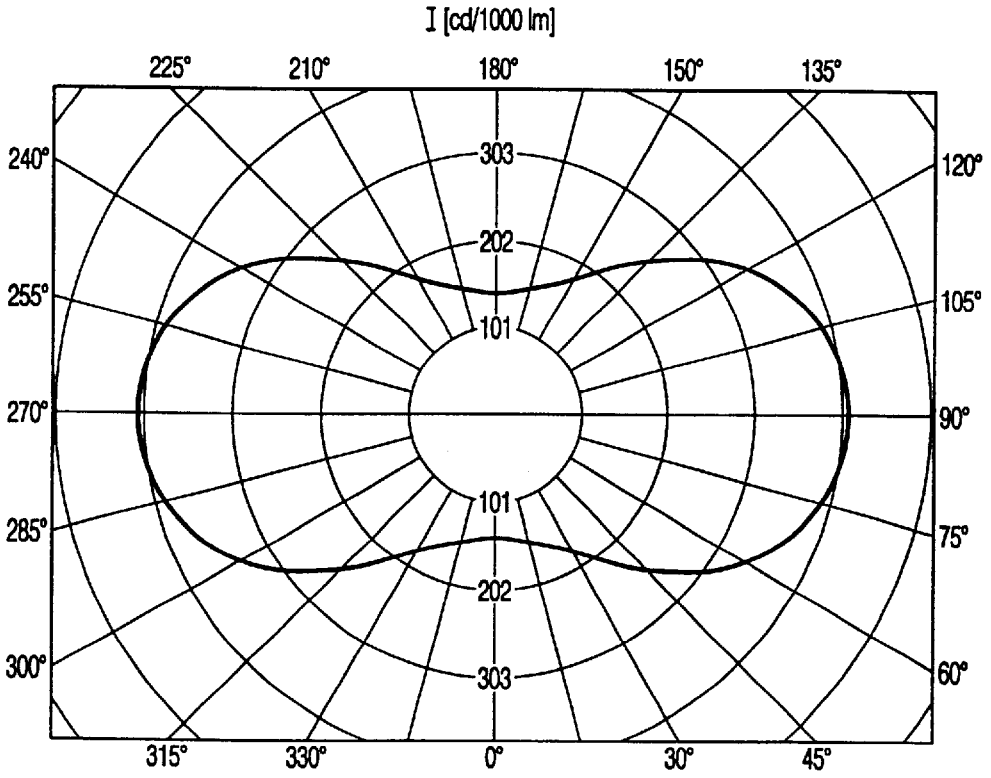

In FIG. 5, the intensity distribution is shown in a conical surface having a base angle of 44°, i.e. through the maximum of line B in FIG. 4. FIG. 5 shows wide lobes, in which a high intensity through an angle of approximately 30° is maintained, which intensity exhibits a gradual decrease. The half-width value of each one of the lobes is approximately 2*55°. The wide lobes are caused by side panels 24 whose flat strips 22 extend towards the light-emission window 3, which flat strips cause the light reflected by the side panels 24 to be on either side of the maximum.

The luminaire has a high output of approximately 80%.

The luminaire can very suitably be mounted in or to the roof of a petrol station, the plane of symmetry S extending in the direction of the traffic. The lamellae 29 preclude dazzling of the drivers, while the vertical surfaces of the petrol pumps are very well lit.

What is claimed is:

1. A luminaire comprising:

a housing (1);

a concave reflector (2) having a light-emission window (3) and, transverse thereto, a plane of symmetry S, in the housing (1);

said reflector (2) having first opposing walls (21), extending along the plane of symmetry S, having flat strips (22) extending along the light-emission window (3), and second, opposing walls (26) extending transversely to the plane of symmetry S, and a top wall (27) opposite the light-emission window (3), characterized in that the top wall (27) has an aperture (28) in the plane of symmetry S, which is covered with a reflective shade (30), said shade (30) including first opposing surfaces (31) extending along the plane of symmetry S, second opposing surfaces (36) extending transversely to the plane of symmetry S, and a top surface (37) opposite the light-emission window (3), and holding means (4) positioned to keep an electric lamp in place in the aperture (28) in the plane of symmetry S.

2. A luminaire as claimed in claim 1, characterized in that the first surfaces (31) of the shade (30) comprise flat strips (32) extending along the light-emission window (3).

3. A luminaire as claimed in claim 1 wherein the second surfaces (36) of the shade (30) are flat and, towards the top surface (37), the distance between them decreases.

4. A luminaire as claimed in claim 3, characterized in that the second walls (21) are flat and the distance between them decreases in the direction of the top wall (27).

5. A luminaire as claimed in claim 1 wherein the first walls (21) are provided with a bend in surfaces extending transversely to the light-emission window (3), so as to form a center panel (23) and side panels (24) connected thereto.

6. A luminaire as claimed in claim 5, characterized in that the side panels (24) in the light-emission window (3) include an angle of 130–135° with each other.

7. A luminaire as claimed in claim 5 wherein the flat strips (22) in the side panels (24) extend, from the center panel (23), towards the light-emission window (3).

8. A luminaire as claimed in claim 1, wherein the top surface (37) has a bent, convex fold (38) which extends in the plane of symmetry S.

9. A luminaire as claimed in claim 1, further comprising a flat transparent shield (5) in the light-emission window (3).

10. A luminaire as claimed in claim 1, further comprising a pair of lamella along (29) extending each one of the second walls (26), the reflector (2) has a first and a second lamella (29) in the light-emission window (3).

* * * * *